US008228007B2

(12) United States Patent
Huang et al.

(10) Patent No.: US 8,228,007 B2
(45) Date of Patent: Jul. 24, 2012

(54) MICROWAVE SUPPLYING APPARATUS AND MICROWAVE PLASMA SYSTEM

(75) Inventors: Chung-Chun Huang, Longtan Township, Taoyuan County (TW); Tsun-Hsu Chang, Hsinchu (TW); Bo-Hung Lin, Kaohsiung (TW); Chi-Wen Hu, Longtan Township, Taoyuan County (TW)

(73) Assignees: Chung-Shan Institute of Science and Technology, Taoyuan County (TW); Armaments Bureau, Ministry of National Defense, Taoyuan County (TW)

( * ) Notice: Subject to any disclaimer, the term of this patent is extended or adjusted under 35 U.S.C. 154(b) by 391 days.

(21) Appl. No.: 12/646,981

(22) Filed: Dec. 24, 2009

(65) Prior Publication Data

US 2011/0156838 A1 Jun. 30, 2011

(51) Int. Cl.
*H01J 25/00* (2006.01)

(52) U.S. Cl. ..... 315/500; 315/501; 315/39.71

(58) Field of Classification Search ..... 315/500, 315/501, 507, 39.71
See application file for complete search history.

(56) References Cited

U.S. PATENT DOCUMENTS 6,661,309 B2 * 12/2003 Chen et al. ..... 333/126
2010/0231144 A1 * 9/2010 Leek ..... 315/505

* cited by examiner

*Primary Examiner* — Douglas W Owens
*Assistant Examiner* — Jianzi Chen

(57) ABSTRACT

The invention discloses a microwave supplying apparatus including a microwave generator, a first power divider, a second power divider, a first waveguide, and a second wave guide. The first waveguide is connected to the microwave generator and has a first output terminal and a second output terminal to divide a microwave generated by the microwave generator along a first direction. The second power divider is connected to the first output terminal and has a third output terminal and a fourth output terminal to divide the microwave along a second direction. The first waveguide and the second waveguide are connected to the third output terminal and the fourth terminal respectively and receive the microwave through the first power divider and the second power divider to respectively output the microwave fields with approximate intensity distributions.

19 Claims, 5 Drawing Sheets

MICROWAVE SUPPLYING APPARATUS AND MICROWAVE PLASMA SYSTEM

BACKGROUND OF THE INVENTION

1. Field of the Invention

The invention relates to a microwave supplying apparatus and microwave plasma system, and particularly, the invention relates to a microwave supplying apparatus capable of supplying a large-area and uniform microwave field and relates to a microwave plasma system using the same.

2. Description of the Prior Art

The microwave plasma is an important tool for the thin film deposition, precision finishing, and surface modification. Because of the high density of ions and high degree of dissociation, the microwave plasma has great activity, reproducibility, and low reaction temperature, and it could be used for PECVD and plasma etching processes in low temperature. Therefore, the microwave plasma is meaningful for the development of large scale integrated circuit, microelectronic device, photoelectric and communication IC, polymer materials, and thin film sensor processes.

Besides, in the electron cyclotron resonance (ECR) microwave plasma, the molecules could be accelerated to gain more energy to result in the density of ion beam, and the processing area of the plasma could be broadened. In other words, the development of the microwave plasma improves the application of ion source.

The usual microwave-plasma apparatus includes a magnetron to generate microwave, and then the microwave is transmitted by the waveguide in specific mode of oscillation through the quartz glass or the dielectric windows to the plasma chamber, so as to ionize the gas by the electric field to produce the plasma.

Recently, to obtain large volume and area plasma, many kinds of microwave plasma source have been developed. These microwave plasma techniques play an important role on the surface modification of large-area semiconductor, photoelectric materials, and polymer materials. The way of producing large-area and uniform plasma is a major issue in the relative field. If the electromagnetic wave could distribute uniform in space, the particles could easily distribute uniform and the plasma could be easily produced.

However, because of the short wavelength of microwave, it is difficult to form a large-area and uniform electromagnetic wave construction. Please refer to FIG. 1. FIG. 1 is a schematic diagram illustrating a microwave field appearance 100 in the prior art. As shown in FIG. 1, the microwave field appearance 100 in the prior art is focus at two focal points. Though the plasma diffusion effect exists, the plasma produced by the microwave with the microwave field appearance 100 has a uniform problem.

The area of the chamber corresponding to the single micro generator is limited. In the prior art, for uniformly distributing the microwave power to a larger area of the reactive region, a microwave dividing device is configured in a microwave source system. Because the conventional microwave field focuses at two points, the microwave dividing device divides the microwave by the way of Y shape (one to two) to transfer the input microwave signal to two similar microwave signals along two directions.

As mentioned above, the microwave field appearance focusing at two points may result in non-uniform ionization of plasma. Besides, the conventional microwave dividing device only provides one-to-two effect in one level, so many levels of microwave dividing devices are needed to satisfy the requirement of the large area of the plasma processes in practice.

SUMMARY OF THE INVENTION

A scope of the invention is to provide a microwave supplying apparatus for providing a large-area and uniform microwave field to solve the above-mention problem.

According to an embodiment, the microwave supplying apparatus of the invention includes a microwave generator, a first power divider, a second power divider, a first waveguide, and a second waveguide. The input terminal of the first power divider is connected to the microwave generator, and the first power divider has a first output terminal and a second output terminal arranged along a first direction. The input terminal of the second power divider is connected to the first output terminal, and the second power divider has a third output terminal and a fourth output terminal arranged along the second direction. The first direction is substantially perpendicular to the second direction. The first waveguide is connected to the third output terminal and the second waveguide is connected to the fourth output terminal.

In the embodiment, the microwave generated by the microwave generator is outputted by the first output terminal and the second output terminal through the first power divider. The second power divider receives the microwave from the first output terminal and the further divides the microwave, and then the third output terminal and the fourth output terminal output microwaves. The first waveguide connected to the third output terminal and the second wave guide connected to the fourth output terminal receive the microwave and then output microwave fields, wherein the microwave fields outputted by the two waveguides have the approximate intensity distributions.

Another scope of the invention is to provide a microwave plasma system for providing a large-area and uniform microwave field to solve the above-mention problem.

According to an embodiment, the microwave plasma system includes a microwave supplying apparatus connected to a chamber of the microwave plasma system, wherein the chamber can contain the plasma gas. The plasma gas contained in the chamber could be ionized by the large-area and uniform microwave field supplied by the microwave supplying apparatus to form large-area and uniform plasma.

In the embodiment, the microwave supplying apparatus includes a microwave generator, a first power divider, a second power divider, a first waveguide, and a second waveguide. The input terminal of the first power divider is connected to the microwave generator, and the first power divider has a first output terminal and a second output terminal arranged along a first direction. The input terminal of the second power divider is connected to the first output terminal, and the second power divider has a third output terminal and a fourth output terminal arranged along the second direction. The first direction is substantially perpendicular to the second direction. The first waveguide is connected to the third output terminal and the second waveguide is connected to the fourth output terminal. Besides, the first waveguide and the second waveguide are connected to the chamber.

The microwave generated by the microwave generator could be transmitted to the first waveguide and the second waveguide through the first power divider and the second power divider, and the first waveguide and the second waveguide could respectively output the microwave fields with approximate intensity distributions to ionize the plasma gas to form the plasma.

Another scope of the invention is to provide a power divider for the microwave supplying apparatus. The microwave supplying apparatus can provide a large-area and uniform microwave field through the power divider.

According to an embodiment, the power divider of the invention can include a first guide tube, a second guide tube, a third guide tube, and a fourth guide tube. The first guide tube could be connected to the microwave generator of the microwave supplying apparatus to receive the microwave generated by the microwave generator. The second guide tube has a central part, a first terminal, and a second terminal. The first guide tube is connected to the central part of the second guide tube, and the first guide tube is substantially perpendicular to the second guide tube. The third guide tube and the fourth guide tube are respectively connected to the first terminal and the second terminal of the second guide tube, and the third guide tube and the fourth guide tube are substantially to the second guide tube.

In the embodiment, the microwave received by the first guide tube from the microwave generator could be divided in the second guide tube and then outputted through the third guide tube and the fourth guide tube.

The advantage and spirit of the invention may be understood by the following recitations together with the appended drawings.

BRIEF DESCRIPTION OF THE APPENDED DRAWINGS

DETAILED DESCRIPTION OF THE INVENTION

Figure 2:
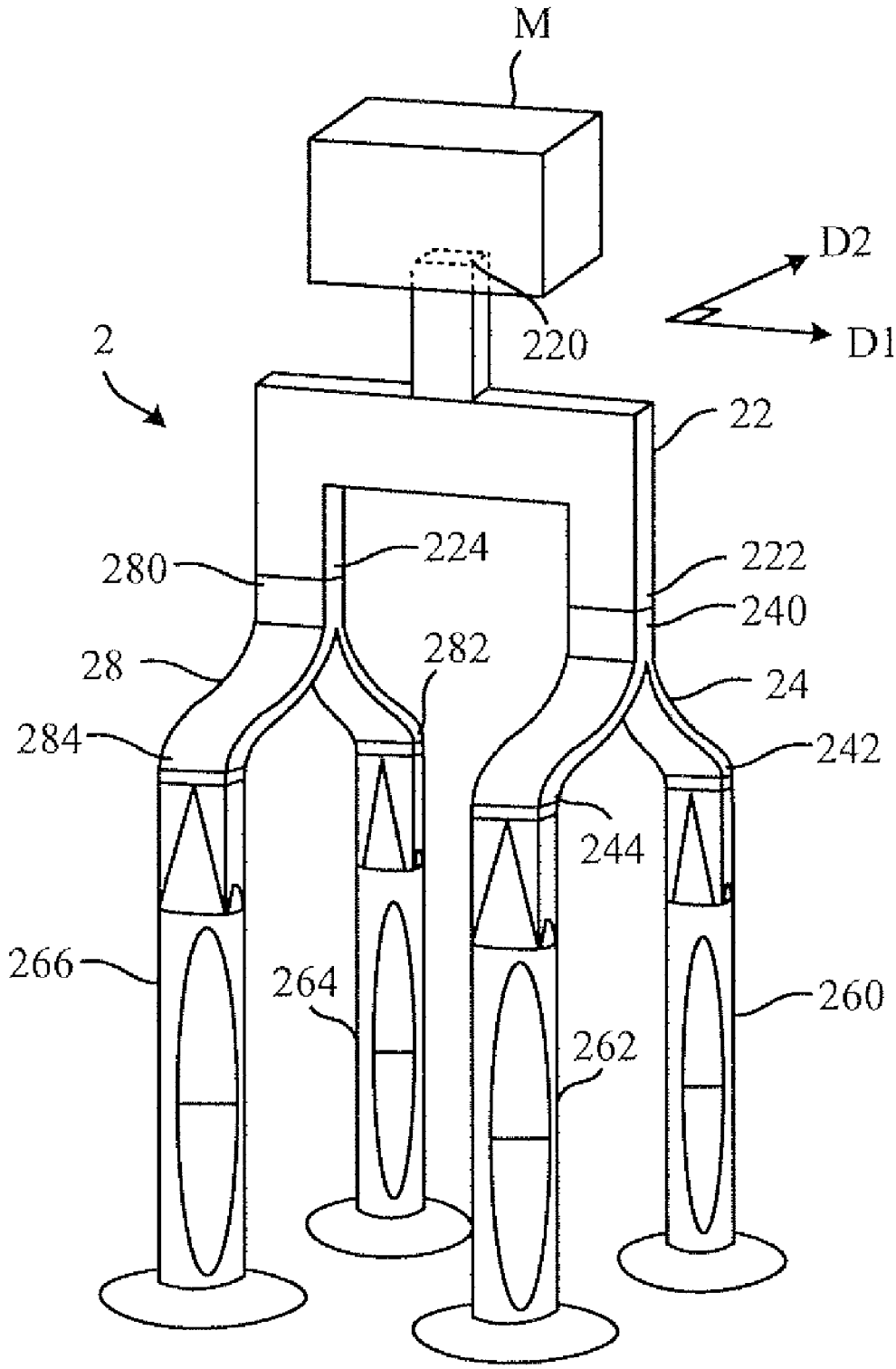
FIG. 2 is a schematic diagram illustrating the microwave supplying apparatus according to an embodiment of the invention.

Please refer to FIG. 2. FIG. 2 is a schematic diagram illustrating the microwave supplying apparatus 2 according to an embodiment of the invention. As shown in FIG. 2, the microwave supplying apparatus 2 includes a first power divider 22, a second power divider 24, a first waveguide 260, and a second waveguide 262.

In this embodiment, the first power divider 22 has a first input terminal 220 capable of being connected to the microwave generator M, therefore the microwave generated by the microwave generator M could be transmitted to the first power divider 22. Besides, the first power divider 22 has a first output terminal 222 and a second output terminal 224 arranged along a first direction D1. The second power divider 24 has a second input terminal 240 capable of being connected to the first output terminal 222 of the first power divider 22, and the second power divider 24 further has a third output terminal 242 and a fourth output terminal 244 arranged along a second direction D2. The first waveguide 260 and the second waveguide 262 could be respectively connected to the third output terminal 242 and the fourth output terminal 244. In practice, the first waveguide 260 and the second waveguide 262 could be respectively connected to a chamber for providing uniform microwave fields to ionize the plasma gas in the chamber to form the plasma.

The microwave generated by the microwave generator M could be respectively outputted by the first output terminal 220 and the second output terminal 222 through the first power divider 22. The second power divider 24 connected to the first output terminal 220 receives the microwave, and then outputs the microwave through the third output terminal 242 and the fourth output terminal 244. The first waveguide 260 and the second waveguide 262 could receive the microwave from the third output terminal 242 and the fourth output terminal 244 and then output the microwave fields with approximate intensity distributions through the output terminals thereof.

Besides, in this embodiment, the microwave supplying apparatus 2 further includes a third power divider 28. The third power divider 28 has a third input terminal 280 capable of being connected to the second output terminal 224 of the first power divider 22, and the third power divider 28 has a fifth output terminal 282 and a sixth output terminal 284 arranged the second direction D2. A third waveguide 264 and a fourth waveguide 266 could be respectively connected to the fifth terminal 282 and the sixth terminal 284. Similarly, the third waveguide 264 and the fourth waveguide 266 could be respectively connected to a chamber for providing uniform microwave fields to ionize the plasma gas in the chamber to form the plasma in practice.

The microwave generated by the microwave generator M could be respectively outputted by the first output terminal 220 and the second output terminal 222 through the first power divider 22. The third power divider 28 connected to the second output terminal 222 receives the microwave, and then outputs the microwave through the fifth output terminal 282 and the sixth output terminal 284. The third waveguide 264 and the fourth waveguide 266 could receive the microwave from the fifth output terminal 282 and the sixth output terminal 284 and then output the microwave fields through the output terminals thereof with approximate intensity distributions as those outputted by the first waveguide 260 and the second waveguide 262.

As described above, the microwave generated by the microwave generator M could be outputted as the microwave fields with approximate intensity distributions through fourth waveguide according to the microwave supplying apparatus 2 in the embodiment. Therefore, the four microwave fields could form a large-area and uniform microwave field.

To averagely distribute the microwave to four waveguide (the first waveguide 260, the second waveguide 262, the third waveguide 264, and the fourth waveguide 266), the first direction D1 which the first output terminal 222 and the second output terminal 224 of the first power divider 22 arranged along is substantially the same as the direction of the magnetic field of the microwave. Besides, the second direction D2 which the third output terminal 242, the fourth output terminal 244, the fifth output terminal 282, and the sixth output terminal 284 of the second power divider 24 and the third power divider 28 arranged along is substantially the same as the direction of the electric field of the microwave. Accordingly, the microwave could be averagely distribute to the third output terminal 242, the fourth output terminal 244, the fifth terminal 282, and the sixth terminal 284, so that the four waveguide could receive the microwave averagely and then output the microwave fields with approximate intensity distributions. Because the first direction D1 is the direction of the magnetic field of the microwave and the second direction D2 is the direction of the electric field of the microwave, the first direction D1 is perpendicular to the second direction D2.

Figure 3:
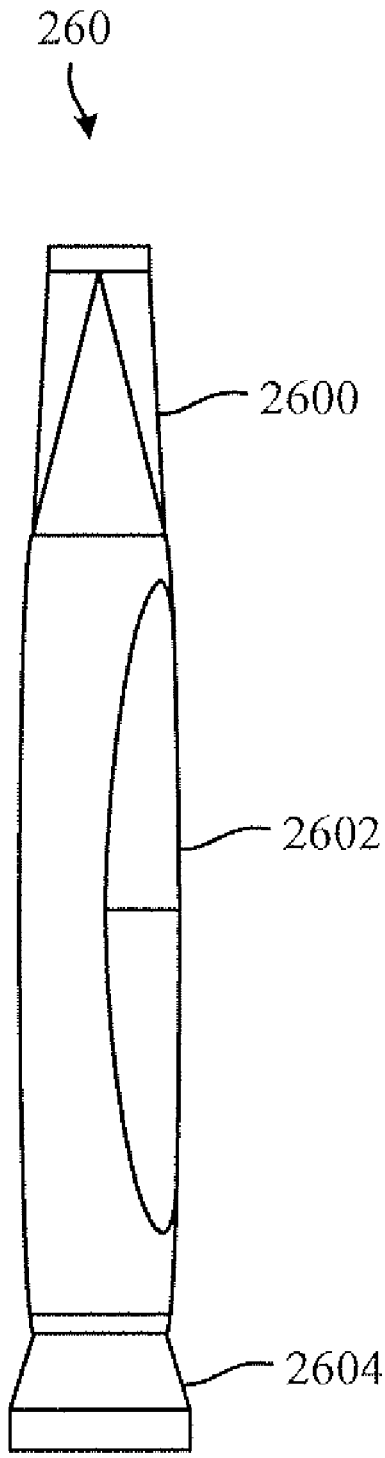
FIG. 3 is a schematic diagram illustrating the first waveguide in FIG. 2.

Please refer to FIG. 3. FIG. 3 is a schematic diagram illustrating the first waveguide 260 in FIG. 2. As shown in FIG. 3, the first waveguide 260 includes a mode converter 2600, a cylindrical waveguide 2602, and a horn output terminal 2604. The mode converter 2600 could be connected to the third output terminal 242 of the second power divider 24 to receive the microwave. In practice, the microwave in mode $TE_{10}$ could be transferred to the microwave in mode $TE_{11}$ through the mode converter 2600. The cylindrical waveguide 2602 is connected to the mode converter 2600 to receive the microwave and then transmit the microwave to the horn output terminal 2604 connected to the cylindrical waveguide 2602. By the horn output terminal 2604, the outputted microwave field could be expanded. It should be noted that the first waveguide 260, the second waveguide 262, the third waveguide 264, and the fourth waveguide 266 have similar constructions, so that the other waveguides are not described in detail here.

Please refer to FIG. 2 again. The second power divider 24 and the third power divider 28 are Y-type shapes. The second power divider 24 and the third power divider with Y-type shapes have well transmittance so as to transmit the microwave and to distribute the microwave to the two output terminal. In practice, if the angle between the two output terminal (between the third output terminal 242 and the fourth output terminal 244, or between the fifth output terminal 282 and the sixth output terminal 284) is smaller, the power divider has smaller reflectivity, and in other words, the power divider has higher transmittance.

Figure 1:
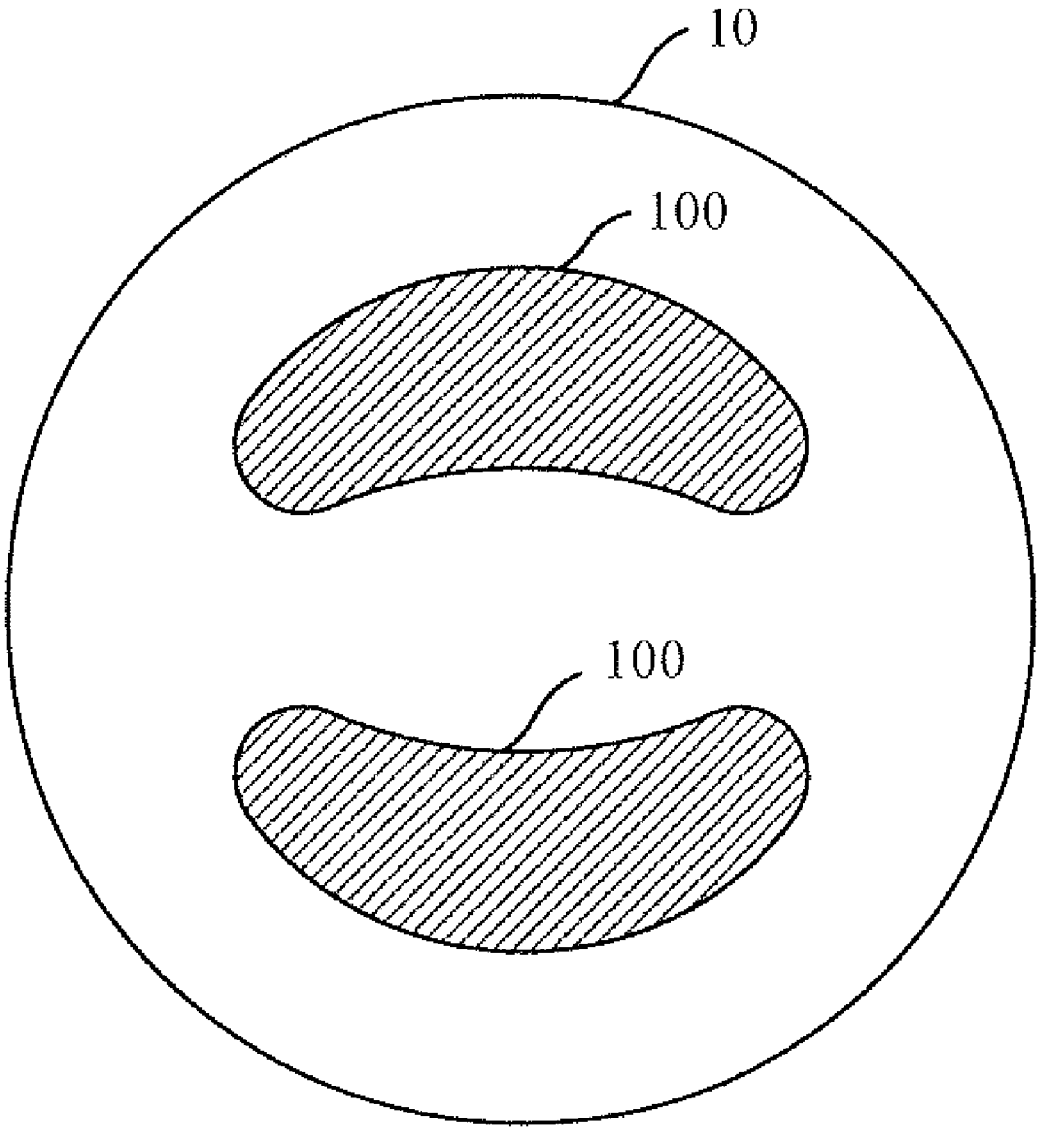
FIG. 1 (Prior Art)
FIG. 1 is a schematic diagram illustrating a microwave field appearance in the prior art.
Figure 4:
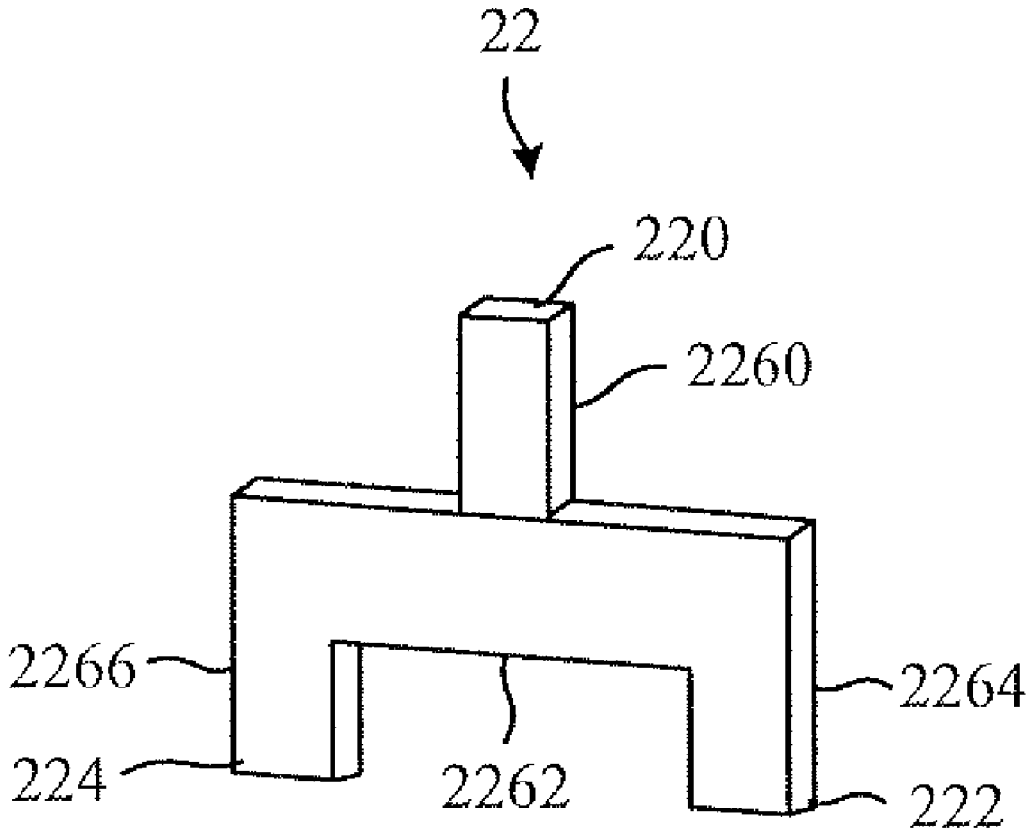
FIG. 4 is a schematic diagram illustrating the first power divider in FIG. 2.

Please refer to FIG. 4. FIG. 4 is a schematic diagram illustrating the first power divider 22 in FIG. 2. As shown in FIG. 4, the first power divider 22 includes a first guide tube 2260, a second guide tube 2262, a third guide tube 2264, and a fourth guide tube 2266, wherein the first input terminal 220 is located on the first guide tube 2260 to be connected to the microwave generator M. The first guide tube 2260 is connected to the central part of the second guide tube 2262, and the first guide tube 2260 is substantially perpendicular to the second guide tube 2262. It should be noted that when the first power divider 22 is configured in the microwave supplying apparatus 2 in FIG. 1, the second guide tube 2262 is substantially configured along the first direction D1. The third guide tube 2264 and the fourth tube 2266 are perpendicularly to two ends of the second guide tube 2262 respectively. By the construction of the first power divider 22, the microwave generated by the microwave generator M could be averagely distributed to the third guide tube 2264 and the fourth guide tube 2266, and the third guide tube 2264 and the fourth guide tube 2266 transmit the microwave to the second power divider 24 and the third power divider 28 through the first output terminal 222 and the second output terminal 224.

The first power divider 22, the second power divider 24, and the third power divider 28 could be rectangular guide tube, that is, each input terminal and output terminal could be rectangular and have the substantially equivalent areas. For example, the first input terminal 220 of the first guide tube 2260 of the first power divider 22 could be the same as the output terminals of the third guide tube 2264 and the fourth guide tube 2266. Therefore, the split flows of the microwave from the third guide tube 2264 and the fourth guide tube 2266 have the same phase. On the other hand, the second power divider 24 and the third power divider 2S respectively branch to two guide tubes and then width of the two guide tubes respectively enlarge to the guide tube before branching. Similarly, the split flows of the microwave from the second power divider 24 and the third power divider 28 have the same phase.

In practice, the second power divider 24 (or the third power divider 28) could make the waveguides arranged along the second direction D2 and then the microwave fields outputted by the waveguides could be arranged along the second direction D2. Besides, the first power divider 22 could make the waveguides and the microwave fields generated thereby arranged along the first direction D1. By the combination of the first power divider 22 and the second power divider 24, the microwave generated by a single microwave generator M could be distributed to a large area to form a large-area and uniform microwave field. It should be noted that the amount of the first power divider and the second power divider (the third power divider) could be determined by the require shape of the microwave field, and it would not be limited in this invention. For example, the two output terminals of the second power divider could be respectively connected to fourth power dividers similar as the second power divider, furthermore, the output terminals of these fourth power dividers are arranged along the second direction. Accordingly, four waveguides arranged along the second direction could be controlled to output microwave fields with approximate intensity distributions.

Figure 5:
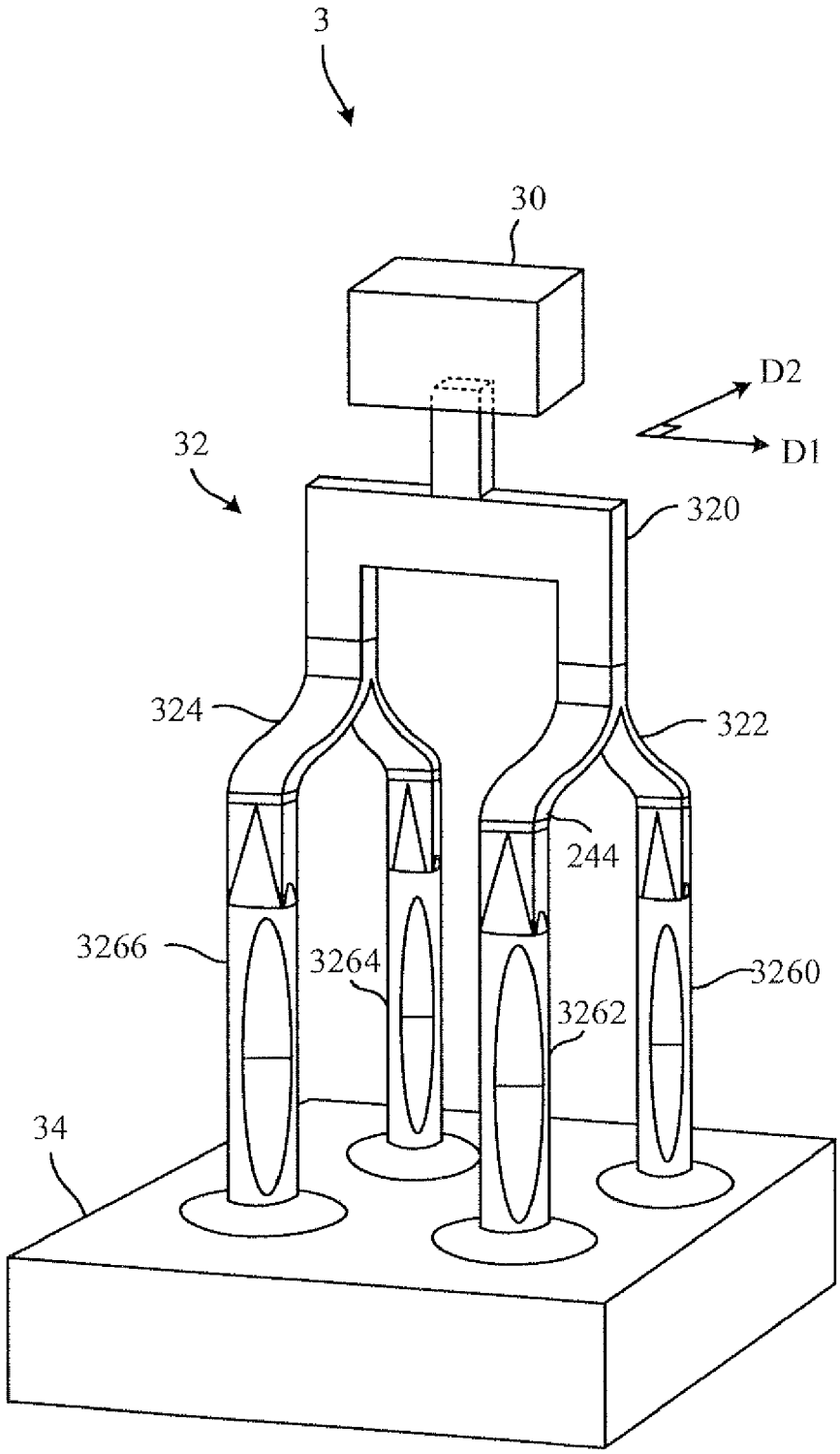
FIG. 5 is a schematic diagram illustrating a microwave plasma system according to another embodiment of the invention.

Please refer to FIG. 5. FIG. 5 is a schematic diagram illustrating a microwave plasma system 3 according to another embodiment of the invention. As shown in FIG. 5, the microwave plasma system 3 includes a microwave generator 30, a microwave supplying apparatus 32, and a chamber 34, wherein the microwave supplying apparatus 32 is connected to the microwave generator 30 and the chamber 34 to receive the microwave generated by the microwave generator 30 and to output a uniform microwave field to the chamber 34. In practice, the plasma gas could be fed in the chamber 34 and be ionized by the microwave to form the plasma.

In this embodiment, the microwave supply apparatus 32 includes a first power divider 320, a second power divider 322, a third power divider 324, a first waveguide 3260, a second waveguide 3262, a third waveguide 3264, and a fourth waveguide 3266. Because the elements of the microwave supplying apparatus 32 in this embodiment are the same as the corresponding elements in the above-mentioned embodiment, it would not be described in detail here. Furthermore, the first waveguide 3260, the second waveguide 3262, the third waveguide 3264, and the fourth waveguide 3266 are connected to the chamber 34.

The microwave generated by the microwave generator 30 is received by the first power divider 320 and distributed to the two output terminals of the first power divider 320. The second power divider 322 and the third power divider 324 receive the microwave from the two output terminals of the first power divider 320, and then divide the microwave received. The first waveguide 3260, the second waveguide 3262, the third waveguide 3264, and the fourth waveguide 3266 connected to the first power divider 322 and the third power divider 324 respectively receive the microwave and output the microwave fields with approximate intensity distributions.

By the first power divider 320, the second power divider 322, and the third power divider 324, a large-area and uniform microwave field could be provided in the chamber 34 and then the plasma gas could be ionized to form large-area and uniform plasma. Besides, according to the amount of the first power divider and the second power divider (or the third power divider), the user or the designer could determine the size of the uniform microwave field.

Compared to the prior art, the microwave supplying apparatus has a simple power divider construction connected to a microwave source and then provides a large-area and uniform microwave field. The microwave supplying apparatus could be used in electron cyclotron resonance (ECR) plasma system. The large-area and uniform microwave field provided by the microwave supplying apparatus could be used for ionizing the plasma gas in the chamber to form large-area and uniform plasma. Therefore, the microwave supplying apparatus and the microwave plasma system of the invention could be used in the present plasma process which requires large-area processing, such as, large-area chip processes or carbon nanotube growth enhanced by the plasma.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A microwave supplying apparatus for receiving and outputting a microwave generated by a microwave generator, the microwave supplying apparatus comprising: a first power divider, having a first input terminal connected to the microwave generator, a first output terminal, and a second output terminal, the first output terminal and the second output terminal being arranged along a first direction; and a second power divider, having a second input terminal connected to the first input terminal, and the second power divider having a third output terminal and a fourth output terminal, the third output terminal and the fourth output terminal being arranged along a second direction substantially perpendicular to the first direction; a first waveguide, connected to the third output terminal; and a second waveguide, connected to the fourth output terminal; wherein, the microwave generated by the microwave generator is transmitted to the first waveguide and the second waveguide through the first power divider and the second power divider to make the first waveguide and the second waveguide to respectively output the microwave fields with approximate intensity distributions.

2. The microwave supplying apparatus of claim 1, further comprising: a third power divider, having a third input terminal connected to the second output terminal, and the third power divider having a fifth output terminal and a sixth terminal arranged along the second direction.

3. The microwave supplying apparatus of claim 2, further comprising: a third waveguide, connected to the fifth output terminal; and a fourth waveguide, connected to the sixth output terminal; wherein, the microwave generated by the microwave generator is transmitted to the third waveguide and the fourth waveguide through the first power divider and the third power divider to make the third waveguide and the fourth waveguide to respectively output the microwave fields with approximate intensity distributions.

4. The microwave supplying apparatus of claim 1, wherein the first direction is substantially the same as the direction of the magnetic field of the microwave generated by the microwave generator, and the second direction is substantially the same as the direction of the electric field of the microwave generated by the microwave generator.

5. The microwave supplying apparatus of claim 1, wherein the first power divider comprises: a first guide tube, the first input terminal being located on the first guide tube; a second guide tube, the first guide tube being connected to a central part of the second guide tube, the first guide tube and the second guide tube are substantially perpendicular to each other, the second guide tube being configured along the first direction and having a first terminal and a second terminal; a third guide tube, connected to the first terminal and substantially perpendicular to the second tube; and a forth guide tube, connected to the second terminal and substantially perpendicular to the second tube.

6. The microwave supplying apparatus of claim 1, wherein the first waveguide is a cylindrical waveguide.

7. The microwave supplying apparatus of claim 1, wherein the first input terminal, the second input terminal, the first output terminal, the second output terminal, the third output terminal, and the fourth output terminal are rectangular.

8. The microwave supplying apparatus of claim 1, wherein the first waveguide comprises a mode converter connected to the third input terminal.

9. The microwave supplying apparatus of claim 1, wherein the first waveguide comprises a horn output terminal to expand the microwave field.

10. A microwave plasma system, comprising: a microwave generator, for generating a microwave; a microwave supplying apparatus, comprising: a first power divider, having a first input terminal connected to the microwave generator, a first output terminal, and a second output terminal, the first output terminal and the second output terminal being arranged along a first direction; and a second power divider, having a second input terminal connected to the first input terminal, and the second power divider having a third output terminal and a fourth output terminal, the third output terminal and the fourth output terminal being arranged along a second direction substantially perpendicular to the first direction; a first waveguide, connected to the third output terminal; and a second waveguide, connected to the fourth output terminal; and a chamber, connected to a first waveguide and the second waveguide, the chamber being for containing a plasma gas; wherein, the microwave generated by the microwave generator is transmitted to the first waveguide and the second waveguide through the first power divider and the second power divider to make the first waveguide and the second waveguide to respectively output the microwave fields with approximate intensity distributions to the chamber for ionizing the plasma gas.

11. The microwave plasma system of claim 10, wherein the microwave supplying apparatus further comprising: a third power divider, having a third input terminal connected to the second output terminal, and the third power divider having a fifth output terminal and a sixth terminal arranged along the second direction.

12. The microwave plasma system of claim 11, wherein the microwave supplying apparatus comprises: a third waveguide, connected to the fifth output terminal and the chamber; and a fourth waveguide, connected to the sixth output terminal and the chamber;

wherein, the microwave generated by the microwave generator is transmitted to the third waveguide and the fourth waveguide through the first power divider and the third power divider to make the third waveguide and the fourth waveguide to respectively output the microwave fields with approximate intensity distributions to the chamber.

13. The microwave plasma system of claim 10, wherein the first direction is substantially the same as the direction of the magnetic field of the microwave generated by the microwave generator, and the second direction is substantially the same as the direction of the electric field of the microwave generated by the microwave generator.

14. The microwave plasma system of claim 10, wherein the first power divider comprises: a first guide tube, the first input terminal being located on the first guide tube; a second guide tube, the first guide tube being connected to a central part of the second guide tube, the first guide tube and the second guide tube are substantially perpendicular to each other, the second guide tube being configured along the first direction and having a first terminal and a second terminal; a third guide tube, connected to the first terminal and substantially perpendicular to the second tube; and a forth guide tube, connected to the second terminal and substantially perpendicular to the second tube.

15. The microwave plasma system of claim 10, wherein the first waveguide is a cylindrical waveguide.

16. The microwave plasma system of claim 10, wherein the first input terminal, the second input terminal, the first output terminal, the second output terminal, the third output terminal, and the fourth output terminal are rectangular.

17. The microwave plasma system of claim 10, wherein the first waveguide comprises a mode converter connected to the third input terminal.

18. The microwave plasma system of claim 10, wherein the first waveguide comprises a horn output terminal to expand the microwave field.

19. The microwave plasma system of claim 10, wherein the chamber further comprising a magnetic field generator for supplying magnetic field to the chamber.

* * * * *